US006503577B2

(12) United States Patent
Keller

(10) Patent No.: US 6,503,577 B2
(45) Date of Patent: Jan. 7, 2003

(54) METHOD OF THERMALLY COATING A CYLINDER BARREL OF A CYLINDER BLOCK OF A COMBUSTION ENGINE

(75) Inventor: Silvano Keller, Böttstein (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 09/758,076

(22) Filed: Jan. 9, 2001

(65) Prior Publication Data

US 2001/0022995 A1 Sep. 20, 2001

(30) Foreign Application Priority Data

Mar. 20, 2000 (CH) ..... 0525/00

(51) Int. Cl.[7] ..... C23C 4/12
(52) U.S. Cl. ..... 427/456; 427/446; 427/236
(58) Field of Search ..... 427/446, 456, 427/236; 118/317

(56) References Cited

U.S. PATENT DOCUMENTS 3,900,639 A 8/1975 Lauterbach ..... 427/348

FOREIGN PATENT DOCUMENTS

| | | |
|---|---|---|
| DE | 197 05 628 A1 | 8/1998 |
| EP | 0 716 158 A1 | 6/1996 |
| GB | 1259 599 | 1/1972 |
| JP | 55047377 | 4/1980 |
| JP | 59052570 | 3/1984 |
| JP | 11221516 | 8/1999 |

*Primary Examiner*—Katherine A. Bareford
(74) *Attorney, Agent, or Firm*—Maginot, Moore & Bowman, LLP

(57) ABSTRACT

A method for thermally coating the cylinder barrels of a cylinder block of a combustion engine is disclosed. Air flows through the cylinder bore whose barrel is to be coated. This air flow is generated by means of extraction, whereby the air is extracted from the bottom of the cylinder bore through the crank case of the cylinder block. For extracting the air, a plurality of extraction collars are provided that are connected to an extraction fan and are moved from the bottom through the crankcase to the lower end of the cylinder bores. The pressure of the air flowing through extraction conduits to the extraction fan is measured and the value of the velocity of the air flow through the cylinder bore is calculated. An adjustment mechanism controls air chokes in the air conduits in response to the calculated flow velocity present in the cylinder bores.

10 Claims, 1 Drawing Sheet

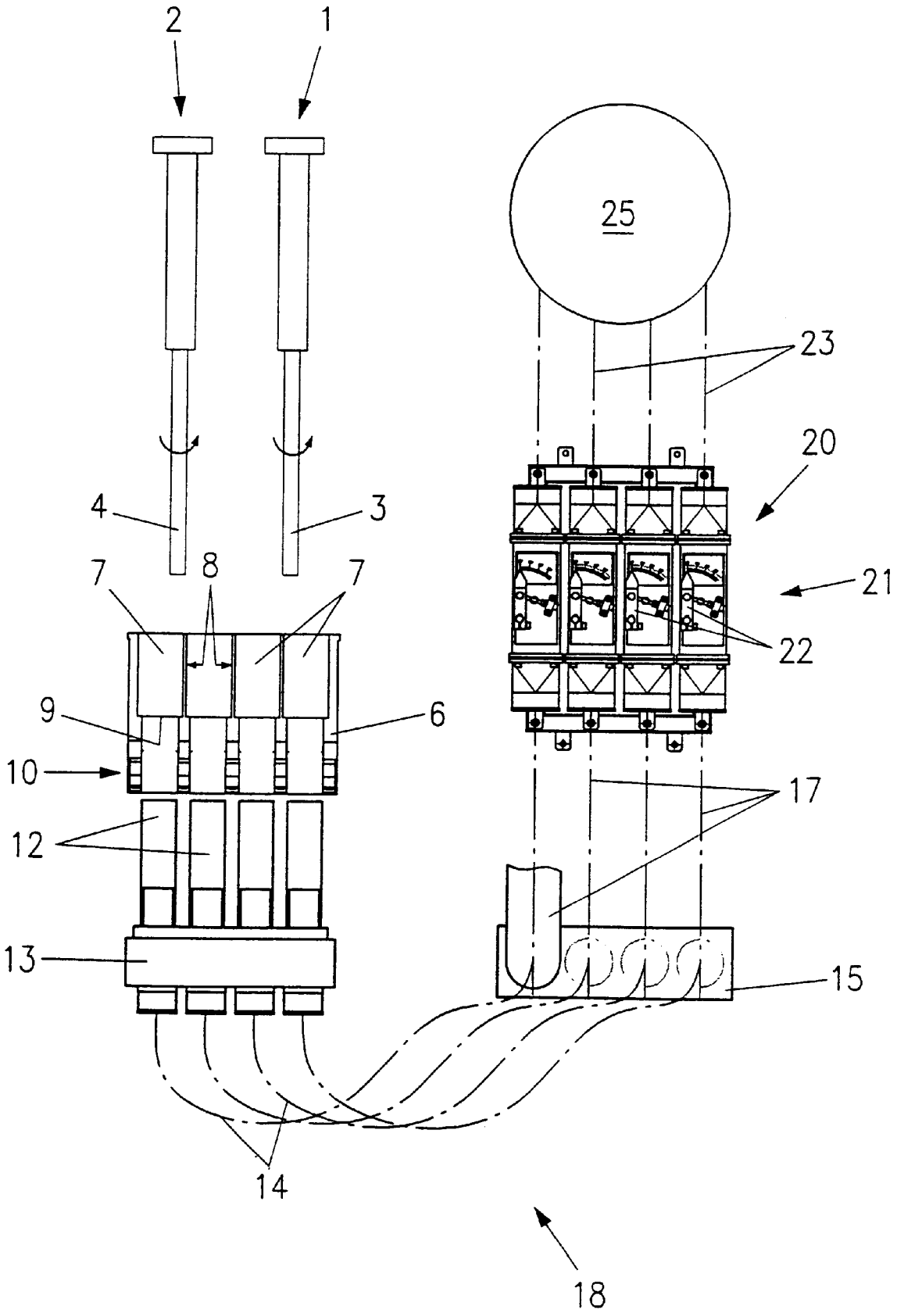
2
1
25
23
20
4
3
7
8
7
21
22
9
6
10
17
12
13
15
14
18

METHOD OF THERMALLY COATING A CYLINDER BARREL OF A CYLINDER BLOCK OF A COMBUSTION ENGINE

BACKGROUND OF THE INVENTION

The present invention refers to a method for thermally coating the cylinder barrels of a cylinder block of a combustion engine as well as to an apparatus for thermally coating the cylinder barrels of a cylinder block of a combustion engine.

In manufacturing combustion engines, nowadays, more and more cylinder blocks made of a light-alloy material are used. In the past, cylinder sleeves made of cast iron have been inserted into those light alloy cylinder blocks for providing an adequate cylinder barrel for the pistons. However, recently, it becomes more and more usual to provide the cylinder barrels of light alloy cylinder blocks with an iron-containing coating material. For applying such a coating material, usually and preferably, rotary plasma guns are used.

Generally, problems may arise in the course of plasma spray coating of a substrate due to the fact that not all particles molten in the plasma jet reliably adhere to the surface of the substrate. Even if this problem is of no meaning at all in many applications, one has to take care that no loose coating particles are left in the cylinder block once the coating operation has been terminated. Up to know, this problem usually was solved by applying cover members to protect exposed locations of the cylinder block. A disadvantage in using such cover members may be seen in the fact that heat accumulations may occur, leading to a high thermal stress of the cylinder block. Moreover, thereby, undesired particle inclusions in the applied coating layer may be generated because environmental dust and not-molten or already cooled-down particles are entrained by the coating jet, causing the above mentioned undesired inclusions.

1. Prior Art

U.S. Pat. No. 5,573,814 discloses a method of masking one or more extremities of a cylinder bore from internal thermal spraying. For this purpose, an inflatable mask member is provided that is pressed against one end, usually the lower end, of the cylinder bore. The mask member comprises a suction conduit for extracting gases from the cylinder bore.

2. Objects of the Invention

Therefore, it is an object of the invention to provide an easily applicable method for thermally coating the cylinder barrels of a cylinder block of a combustion engine in which the quality of the coating applied to the cylinder barrel can be improved.

It is a further object of the present invention to provide an easily applicable method for thermally coating the cylinder barrels of a cylinder block of a combustion engine in which the cylinder block is protected from contamination during the coating operation.

It is a still further object of the present invention to provide an apparatus for thermally coating the cylinder barrels of a cylinder block of a combustion engine by means of which the method of the invention can be easily and quickly performed.

SUMMARY OF THE INVENTION

To meet these and other objects, according to a first aspect, the present invention provides a method for thermally coating the cylinder barrels of a cylinder block of a combustion engine in which a plasma spraying gun having a preferably rotary plasma spraying head is moved into the interior of the cylinder bore of the cylinder whose barrel is to be coated. Before the coating operation is initiated, a flow of air is created through said cylinder bore whose barrel is to be coated. The flow of air has a flow velocity of between 7 m/s and 12 m/s and is maintained during the entire coating operation.

According to a second aspect, the present invention provides an apparatus for thermally coating the cylinder barrels of a cylinder block of a combustion engine. The apparatus comprises a plasma spraying gun having at least one preferably rotary plasma spraying head and a mechanism for moving the plasma spraying head or heads into the interior of the cylinder bore of the cylinder whose barrel is to be coated. An air extraction member has a plurality of extraction collars and a plurality of at least partially flexible conduits for connecting the extraction collars with an extraction fan. Moreover, means are provided for varying the cross section of the conduits.

Surprisingly, using the method and the apparatus of the invention it was found that the quality of the applied coating is improved in different regards and that, simultaneously, the cylinder block is also protected from contamination. In particular, if the air is extracted from the interior of the cylinder bore whose barrel is to be coated with a flow velocity of between 7 m/s and 12 m/s, the coating particles not adhering to the barrel surface are reliably removed and the content of oxygen bound in the applied coating is kept in a region in which both the tribologic properties of the coating and the machining properties thereof are optimized. Moreover, due to the air flowing through the cylinder bores, the cylinder block is kept cooler than usual. Finally, using the method according the invention, the contamination of the plasma gun and its rotary head, respectively, is reduced.

BRIEF DESCRIPTION OF THE DRAWING

In the following, the method of the invention will be further described with the aid of an embodiment of the apparatus according to the invention and with reference to the accompanying drawing, in which a schematically drawn cylinder block and an also schematically illustrated extraction fan assembly is shown.

DETAILED DESCRIPTION OF THE INVENTION

Generally, the drawings shows, in a schematical way, two plasma spraying apparatuses 1, 2, a cylinder block 6 of a combustion engine as well as an extraction fan assembly 18. For coating the cylinder barrels 8 of the e.g. 4-cylinder engine block 6, two plasma spraying apparatuses 1, 2 having rotating plasma spraying heads 3, 4 are provided. The extracting fan assembly 18 comprises four extraction collars 12, a control assembly 20 provided with air chokes as well as an extraction fan member 25. In this view of the control assembly 20, the air chokes per se are not visible, but their adjustment mechanism 22.

In the present example, the control assembly 20 comprises a air choke battery 21 including four air chokes. The four extraction collars 12 are fixed to a support member 13 and are connected to the control assembly 20 by means of four flexible hoses 14, whereby the hoses 14 are schematically shown in the drawing as dash-dotted lines only.

The flexible hoses 14 run to a connector element 15 connected to the control assembly 20 by means of conduits 17. The control assembly 20 is connected to an extraction fan 25 by means of conduits 23. Moreover, the control unit is provided with pressure sensor means (not shown in the drawing); thus, during the air extracting operation, the pressure in the hoses 14 and the conduits 17 can be measured.

The coating operation of the cylinder barrels 8 is generally performed as follows:

First, the four extraction collars 12 are moved through the crank case 10 of the cylinder block 6 to the lower end 9 of the cylinder bores 7. Thereafter, the real coating operation is initiated by moving the plasma spraying apparatuses 1, 2 into the two of the cylinder bores 7 and by spraying a suitable material, such as a metal containing coating, preferably an iron containing coating, with the help of the rotating spraying heads 3, 4 to the inner walls of the cylinder bores 7 to provide a coating on the cylinder barrels 8. This operation is well known in the art and has not to be explained in more detail.

During the coating operation, air is continuously extracted from the interior of the cylinder bores 7 by means of the extracting fan assembly 18. Simultaneously, the pressure in the extraction hoses 14 and in the conduits 17 is measured. Based on the measurement data of the air pressure, the flow velocity of the air flowing through the cylinder bores 7 can be calculated. It is understood that the present apparatus further comprises (not shown) electronic means for calculating the afore mentioned air flow velocity on the basis of the measured pressure in the extraction hoses 14 and conduits 17, respectively.

In order to adjust the air flow velocity in the interior of the cylinder bores 7 to the desired value of between 7 m/s and 12 m/s, the position of the air chokes and, thereby, the extraction cross section can be varied by means of the adjustment mechanism 22.

As soon as the two afore mentioned cylinder barrels 7 of the four cylinder engine block 6 are coated, the two plasma spraying apparatuses 1, 2 are removed from the cylinder bores 7, repositioned and moved into the interior of the two remaining cylinder bores 7 to coat the cylinder barrels 8 thereof in the same manner as described herein before, whereby the air flow velocity is kept again at a value of between 7 m/s and 12 m/s.

It has been found the an air flow velocity of between 7 m/s and 12 m/s is an optimum in various regards. Thereby, on the one hand, it is ensured that the coating particles not adhering to the surface of the cylinder barrel 7 as well as other particles, e.g. dust particles, are reliably removed from the interior of the cylinder bore 7, even if there should be a gap between the lower end 9 of the cylinder bore 7 and the associated extraction collar 12. Consequently, the provision of a sealing member between the lower end 9 of the cylinder bore 7 and the associated extraction collar 12 is not required, with the result that a quick, efficient and affordable coating operation of the cylinder barrels 7 is favored. On the other hand, by ensuring that air flows through the cylinder bore 7 with a flow velocity of between 7 m/s and 12 m/s during the coating operation, the content of oxygen bound in the coating layer is kept in the region of between 1 to 4% by weight; thus, both the tribologic properties of the coating and its machinability are optimized. Moreover, the air flowing through the cylinder bores 7 cools the cylinder block 6 and reduces a contamination of the plasma spraying heads 3, 4.

If the air flows through the cylinder bores 7 with a velocity higher than 12 m/s, the danger arises that the plasma jet is disturbed and that the coating particles are not fully molten any longer, with the result that one gets a coating of inferior quality, having e.g. a not acceptable porosity. If the air flows through the cylinder bores 7 with a velocity lower than 7 m/s, the danger arises that the content of oxygen bound in the coating layer is too high, again resulting in an undesired inferior coat quality. Moreover, if the velocity of the air flowing through the cylinder bores 7 is too low, the danger arises that the dust concentration in the cylinder bore 7 to be coated becomes too high, with the result that a number of coating particles can escape from the cylinder bore 7 through a possibly existing gap between the lower end 9 of the cylinder bore 7 and the extraction collar 12 into the interior of the crankcase 10 of the engine cylinder block 6. In the case of a V-6 or V-8 engine, some of the coating particles even could reach the cylinder bore opposite to the cylinder bore that is coated.

The embodiment of the apparatus shown in the drawing and herein before described is well suited for coating the cylinder barrels 8 of four cylinder in-line engine blocks as well as of eight cylinder engines in V-8 configuration. However, it is understood that the apparatus can be designed to be used for coating the cylinder barrels of engine blocks having a different configuration.

What is claimed is:

1. A method for thermally coating a cylinder barrel of a cylinder block of a combustion engine, comprising the steps of:

providing a plasma spraying means having at least one plasma spraying head means;

moving said at least one plasma spraying head means into a cylinder bore defined by the cylinder block;

providing a flow of air through said cylinder bore, said flow of air having a flow velocity of between 7 m/s and 12 m/s;

spraying a coating material onto said cylinder barrel which is located in said cylinder bore with said at least one plasma spraying head means; and maintaining said flow of air during said spraying step.

2. The method of claim 1 in which said coating material includes a metal containing coating.

3. The method of claim 2 in which said metal coating material includes am iron containing coating.

4. The method of claim 1 in which said flow of air is created by an extraction operation, whereby air is extracted from the interior of the cylinder bore.

5. The method of claim 4, further comprising the step of moving an extraction collar through a crank case of said cylinder block toward a lower end of said cylinder bore, said extraction collar being in fluid communication with an extraction fan via a conduit.

6. The method of claim 5, further comprising the steps of:

measuring said air pressure in said conduit during the spraying step so as to determine a measured air pressure, and calculating an air flow velocity value based on said measured air pressure.

7. The method of claim 6, wherein an air choke device is provided in said conduit, wherein an adjustment mechanism is in operational connection with said air choke device, and further comprising the step of controlling the flow velocity of said flow of air through said cylinder bore with said adjustment mechanism based on said air flow velocity value.

8. The method of claim 4 which said flow of air exits said cylinder bore through a lower end thereof.

9. The method of claim 8 which:

said cylinder block case having a passage defined therein, and said flow of air advances from said lower end of said cylinder block into said passage of said crank case.

10. The method of claim 9 in which said flow of air further advances out of a lower end of said passage of crank case.

* * * * *